US005909959A

United States Patent [19]

Gerich

[11] Patent Number: 5,909,959

[45] Date of Patent: Jun. 8, 1999

[54] COMPACT FLUID MIXER

[76] Inventor: Horst Gerich, 1652 Golconda Ct., Minden, Nev. 89423

[21] Appl. No.: 08/964,306

[22] Filed: Nov. 4, 1997

[51] Int. Cl.[6] ..... B01F 5/00

[52] U.S. Cl. ..... 366/339; 222/459

[58] Field of Search ..... 366/339, 338, 366/336, 181.5; 222/459, 145.6

[56] References Cited

U.S. PATENT DOCUMENTS

| | | | |
|---|---|---|---|
| 3,119,704 | 1/1964 | Harrell et al. . | |
| 3,185,447 | 5/1965 | Hach . | |
| 3,779,518 | 12/1973 | Koepke et al. | 366/339 |
| 3,827,888 | 8/1974 | Terwilliger et al. | 366/339 |
| 3,941,355 | 3/1976 | Simpson . | |
| 4,305,672 | 12/1981 | Adams . | |
| 4,316,673 | 2/1982 | Speer . | |
| 4,361,407 | 11/1982 | Pellegrini . | |
| 4,641,705 | 2/1987 | Gorman | 366/339 |
| 4,643,336 | 2/1987 | Mandeville et al. | 366/339 |
| 4,854,721 | 8/1989 | Hume . | |
| 4,907,725 | 3/1990 | Durham . | |
| 5,174,651 | 12/1992 | Gaddis | 366/339 |
| 5,350,233 | 9/1994 | Sonntag et al. | 366/339 |
| 5,433,084 | 7/1995 | Kaiser et al. | 366/339 |

FOREIGN PATENT DOCUMENTS

| | | | |
|---|---|---|---|
| 2146912 | 5/1985 | United Kingdom | 366/339 |

*Primary Examiner*—Tony G. Soohoo
*Attorney, Agent, or Firm*—Kenneth J. Hovet

[57] ABSTRACT

A compact assembly for mixing two or more fluids comprising a housing having interior serpentine flow channels. The channels are defined by alternating upward and downward extending partitions. The tip end of each partition is offset from respective interior surfaces of the housing top and bottom walls. Each offset defines a curved passage which interconnects the channels and forms a continuous zigzag flow path through the housing. Fitted within the channels are preformed static mixing units to provide additional mixing action.

8 Claims, 3 Drawing Sheets

COMPACT FLUID MIXER

BACKGROUND OF THE INVENTION

1. Field of the Invention

The present invention relates to an apparatus of compact length that directs and mixes fluids.

2. Description of the Prior Art

Many industrial and manufacturing applications require mixing fluids and applying the mixtures to a designated area. Mixing is often accomplished by directing a pressurized flow through a mixing device comprising a housing and mixing means, where the mixing means include static mixers that align longitudinally along the length of the housing.

Moreover, many applications often require mixing two fluids that are difficult to mix. In such instances, a satisfactory mixture may be created by exposing the fluids to a mixing means for an extended period of time.

With reference to FIG. 1, a mixture of such fluids is accomplished by the prior art device comprising a housing 60 that is elongated to accommodate a necessary number of axially aligned static mixers. In this manner, elongation of housing 60 increases the exposure of such fluids to a mixing means.

However, the elongated dimensions of the prior art device has disadvantages. Most notably, the elongated housing distances the user from the surface being supplied with the mixture, thereby making precision application of the mixture difficult. The additional length of the prior art device also renders it tedious and cumbersome to the user.

SUMMARY OF THE INVENTION

The invention pertains to an apparatus that mixes fluids, including resins and polymers, by directing the fluids through two or more channels containing mixing means. More specifically, the invention mixes fluids in a housing optimized for compactness, thereby providing a user-friendly apparatus capable of precisely applying the resulting mixture to a designated area. In this manner, the invention provides a modular and disposable mixing apparatus that may be fitted to engage existing control and dispensing mechanisms.

Basic elements of the invention include a housing containing two or more parallel channels, with one or more curved passages that interconnect the channels in series. The housing may comprise opposing partitions that define the channels and passages. Each channel may include a mixing means for mixing the fluids that are directed through the channel. Preferably, the mixing means comprises static mixers which are dimensionalized with respect to the channels and passages, such that they are stationary within the respective channels.

The channels and passages may combine in succession to form an up and down or zigzag pathway that directs the fluid within a housing of optimal minimal length between control mechanism and nozzle. The particular design or embodiment of the housing, including the number of channels, passages and mixers used, as well as the alignment and dimensions of each element of the assembly, may be altered to accommodate various fluids with varying viscosities and chemical properties. For example, the cumulative axial length of the zigzag pathway may be varied by the number of channels incorporated within the housing. Alternatively, the mixing apparatus may comprise a hybrid housing that combines the aforementioned zigzag pathway with the prior art mixing device shown in FIG. 1.

DESCRIPTION OF THE PREFERRED EMBODIMENTS

Figures 1, 2:
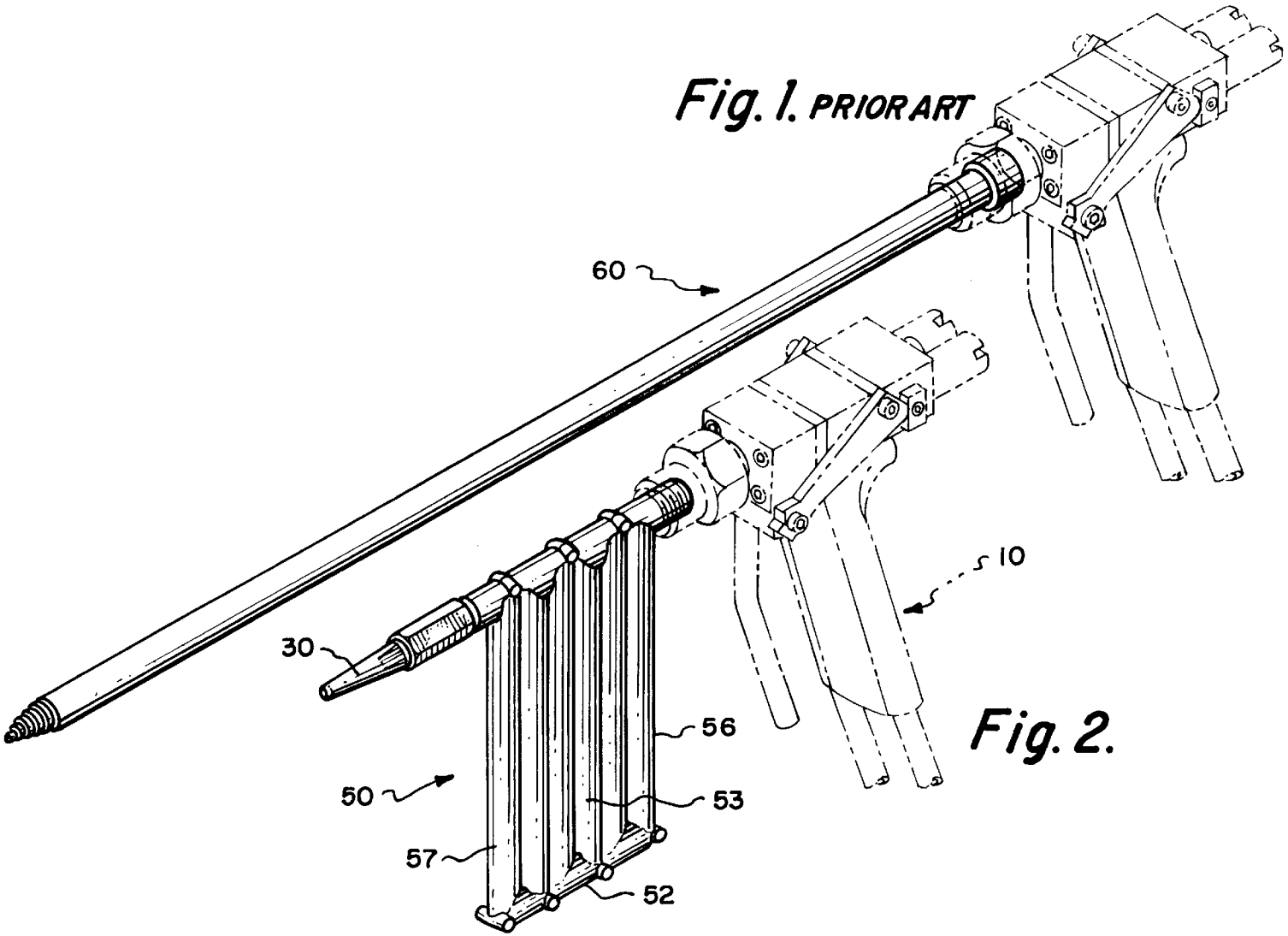
Fig. 1. PRIOR ART
FIG. 1 is a front isometric view of a prior art mixing tube attached to a dual fluid dispensing control device shown in phantom.
FIG. 2 is a front isometric view of an embodiment of the present invention comprising a mixing apparatus attached to a dual fluid dispensing control device shown in phantom.
Figure 3:
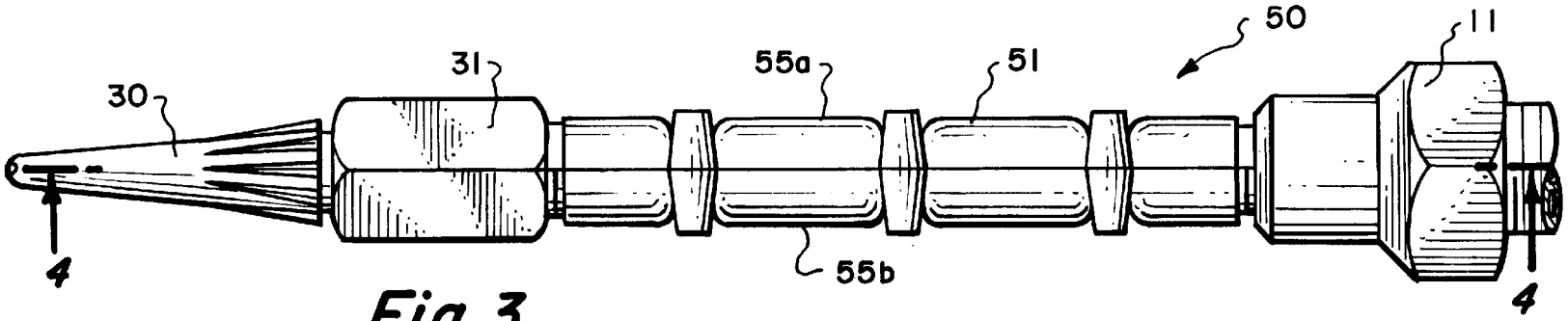
FIG. 3 is an enlarged top plan view of the apparatus of FIG. 2.
Figure 5:
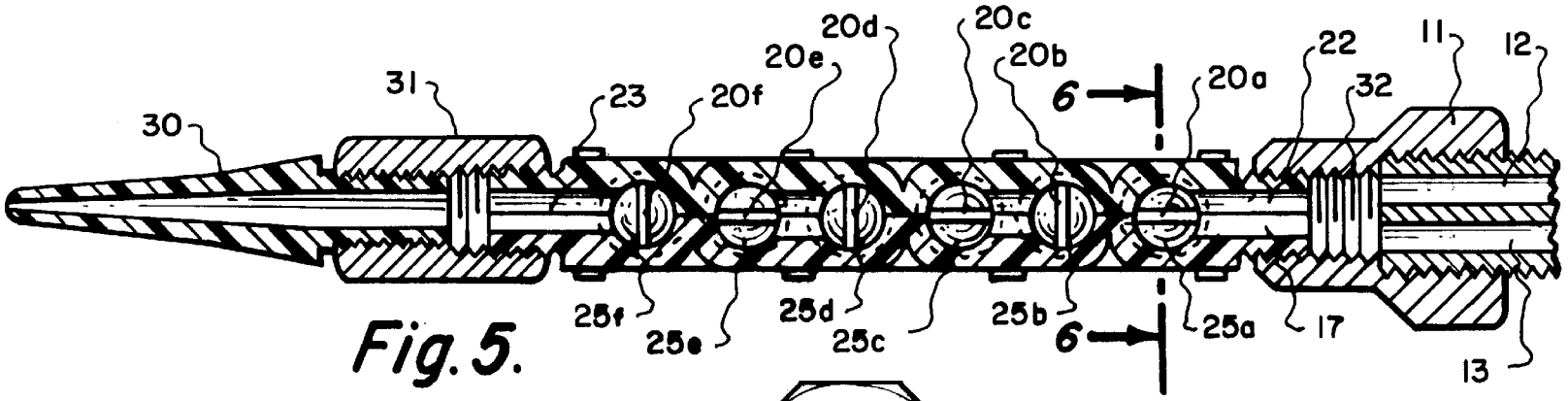
FIG. 5 is a cross-sectional view taken along lines 5—5 of FIG. 4.
Figure 6:
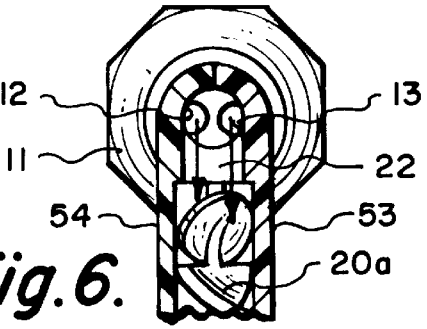
FIG. 6 is a cross-sectional view taken along lines 6—6 of FIG. 5.

The invention sets forth a housing 50 having a fluid pathway that, instead of being straight, is zigzag or comprised of two or more parallel straight segments which are connected in series. To accommodate the pathway of the invention, FIGS. 2, 3 and 6 show that the overall housing 50 is contoured and rectangular. It comprises a top wall 51 and bottom wall 52 which merge into a front wall 53 and back wall 54. The housing includes a right side wall 56 connected to a control and dispensing mechanism 10. A left side wall 57 is connected to an outlet nozzle 30.

Suitable materials for constructing the housing include plastic or durable polymers, as well as metals such as steel alloys. Preferably, the housing is molded from plastic or polymer because it costs less and allows the housing to be disposable if desired. Furthermore, the zigzag fluid pathway may be more efficiently integrated into the housing through molding techniques known in the art.

With reference to FIG. 3, the housing comprises mirror-image halves 55*a* and 55*b* bisected along the longitudinal extent of the housing. Each half is individually molded, with one half being fitted with static mixers 20 hereinafter described. The housing may then be formed by sealing the two halves together along the edges defined by the housing walls and partitions described herein. Sealing the housing halves together may be accomplished by additional molding, heat fusion, adhesives, sonic bonding, mechanical fasteners and gaskets or other sealing means known in the art.

Figure 4:
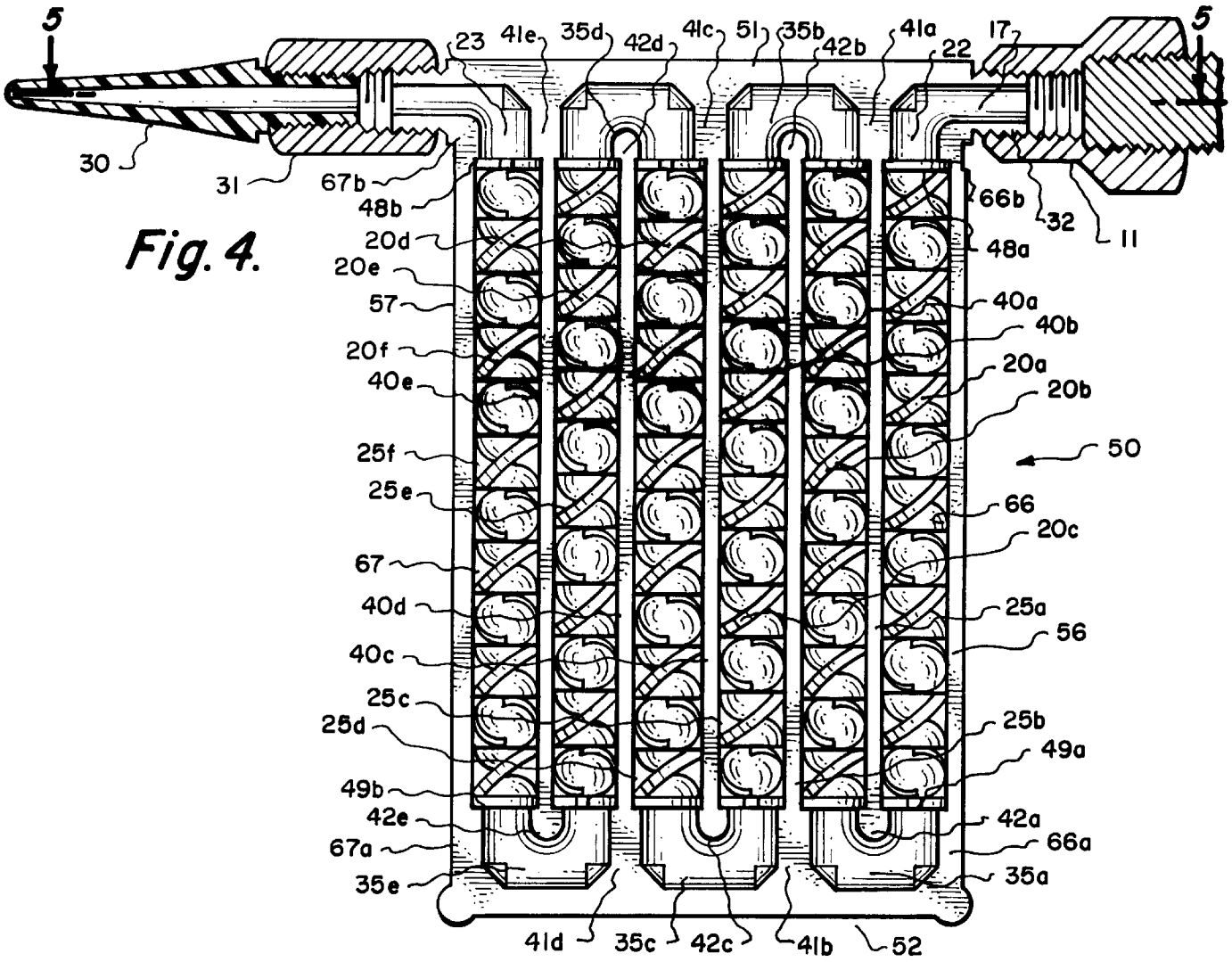
FIG. 4 is a cross-sectional view taken along lines 4—4 of FIG. 3.

With particular reference to FIG. 4, a cross-section of a completed housing is shown to include a plurality of parallel straight channels 25, with curved passages 35 interconnecting the channels in series. In the preferred embodiment, the channels and the passages are defined by the housing walls and a number of opposing partitions 40 within the housing. The partitions are straight and parallel and are spaced an equidistant apart from each other along the longitudinal axis extending from the right sidewall 56 to the left sidewall 57. The first partition 40*a* is nearest to the right sidewall 56.

The partitions 40(*a*–*e*) define a uniform tubular channel and are dimensionalized to closely interfit with the aforementioned static mixers. The partitions extend from respective stems 41(*a*–*e*) to a corresponding distal tip. Each stem is integrated with respective top or bottom wall portions of the housing in an alternating fashion.

In particular, first partition 40*a* extends from stem section 41*a* at top wall 51, downwardly to a distal tip 42*a*. The tip is spaced apart from bottom wall 52 so that it defines the width of a U-shaped passage 35*a* discussed herein. The stem 41*a* and tip 42*a* have a thicker cross-section than the partition 40*a*, such that the partition integrates with the stem and tip to form a top right shoulder 48*a* and bottom right shoulder 49*a*. Each subsequent channel contains a shoulder which extends symmetrically to the left and right side of the respective partition.

The second partition 40*b* is identical to the adjacent first partition 40*a*, except that stem 41*b* integrates with bottom wall 52, and tip 42*b* defines the width of a second passage 35*b*. Likewise, the location of the stem 41 of each subsequent partition alternates from the top to the bottom wall, with each tip defining the width of a separate passage 35.

Right sidewall 56 has an interior surface 66 which mirrors the opposing partition 40*a*. Likewise, left sidewall 57 has an interior surface 67 which mirrors the opposing partition 40*e*.

With reference to FIG. 4, the partition 40*a* and right interior surface 66 define a first straight channel 25*a*. Within the channel 25*a* is static mixer 20*a*. Although other mixers could be used, mixer 20*a* is shown as having curved inclined blades, circuitously arranged about a longitudinal axis, to direct the fluid in a tortuous helical path through the channel 25*a*. The mixer and channel have almost equal diameters such that the channel compactly houses the mixer to avoid fluid by-pass. Vertical movement of mixer 20*a* is precluded by securement means shown as the aforementioned top and bottom shoulders 48*a* and 49*a*.

In a similar fashion, the areas between each successive partition forms identical channels 25(*a–f*) within which are positioned respective identical static mixers 20 (*a–f*). Also, channel 25*f* is formed by interior surface 67 and the corresponding opposing surface of partition 40*e*.

With further reference to FIG. 4, the aforementioned channels 25 are connected in series by U-shaped passages 35(*a–e*). A first passage 35*a* directs the fluid about 180 degrees from the end of channel 25*a* to the beginning of channel 25*b*. The passage 35*a* is formed within the housing 50 by the right thickened bottom segment 66*a* of the right interior surface 66 and a corresponding opposing segment of the stem 41*b* of the second partition.

It can also be seen that the junction between right thickened segment 66*a* and right interior surface 66 form a portion of shoulder 49*a*. In the same way, the junction of left thickened segment 67*a* and left interior surface 67 form a lower portion of shoulder 49*b*. In a similar manner, a second passage 35*b* directs the fluid from the end of channel 25*b* to the beginning of channel 25*c*. The passage 35*b* is formed by the stems 41*a* and 41*c*, with the tip 42*b* defining the width of the passage 35*b*.

The remaining stems and tips combine to form five passages in all, such that each passage connects a successive pair of adjacent channels in sequence. The alignment of the partitions allows the housing 50 to direct the fluid along the channels and passages in a zigzag path, where each channel alternatively directs the fluids upward or downward through respective static mixers, and where the passages 35 connect the channels in series.

The embodiment disclosed herein comprises five partitions, with the stem 41*e* of the last partition integrated with the top wall 51. The number of partitions may be varied to accommodate more or less channels and passages.

As depicted in FIGS. 1,2 and 6, the housing is engaged with a control and dispensing device 10 shown in phantom. The device 10 is part of an overall pump and control assembly for mixing and delivering two or more fluids to an end-use application. One control device particularly useful with the present invention is set forth in U.S. Pat. No. 5,477,988.

The fluid dispensing and control mechanism 10, shown in phantom in FIG. 1, directs two fluid streams through respective outlets 12 and 13 into an outlet adaptor 11. The adaptor threadably engages housing inlet 32 having a tubular interior 17. The two fluids merge as they flow into the tubular interior and pass into entrance passage 22 of the housing. The space between top right thickened segment 66*b* of right interior surface 66 and the corresponding portion of stem 41*a* define the entrance passage. The passage 22 curves about ninety degrees to direct the merged fluids into the beginning of first channel 25*a*.

The fluid progresses in a zigzag path through the housing, where it ultimately passes through channel 25*f* and out exit passage 23. The exit passage is a mirror image of entrance passage 22. It is defined by the space between the left thickened segment 67*b* of left interior surface 67 and the corresponding opposing portion of stem 41*e*. It can be seen that the junction between the left thickened segment and left interior surface 67 form top left shoulder 48*b*.

The exit passage curves about ninety degrees from the end of channel 25*f* and directs the mixed fluids through the interior of an outlet coupling 31 to a nozzle 30. The nozzle allows for precise application of the mixed fluid to a defined surface.

While the invention has been described with respect to a preferred embodiment, it will be apparent to those skilled in the art that various modifications and improvements may be made without departing from the spirit and scope of the invention. Accordingly, it is to be understood that the invention is not to be limited by the specific illustrative embodiments, but only by the scope of the appended claims.

I claim:

1. In an apparatus for mixing together two or more fluids comprising:

a housing having a fluid inlet and a fluid outlet, said housing defined by a top and bottom wall which are integrated with opposing sidewalls and a front and a back wall;

said top and bottom wall including at least one stem section from which extends a respective partition, said partition extending from said respective stem section to a terminal end spaced apart from either said bottom or top wall respectively;

said stem section having a shoulder and said partition defining at least two channels aligned in parallel, where each channel is connected in series by curved passages defined by said partitions and walls; and, said channels including static mixing means for enhancing the mixing of said fluids wherein said stem section includes a shoulder and said static mixing means comprises predetermined individual mixing units maintained within said channels by said shoulder.

2. A compact mixer for two or more fluids comprising a housing having two or more partitions, where adjacent partitions define two or more channels and one or more passages which interconnect adjacent channels in series with at least two channels being aligned in parallel and each channel including a means for mixing fluids, said housing having a top wall and bottom wall from which extend stem sections, each partition extending from a respective stem section, said stem sections having a thicker cross-section than said partition whereby a shoulder is formed on said stem section.

3. The mixer of claim 2 wherein said channels are oriented in the same plane.

4. The mixer of claim 2 wherein said passages define about a U-shaped fluid flow path.

5. The mixer of claim 4 wherein said housing includes a fluid inlet and a fluid outlet which are aligned about perpendicular to said channels.

6. The mixer of claim 2 wherein said channels are straight.

7. The mixer of claim 2 wherein said means for mixing fluids comprises preformed static mixing units which are maintained in said channels by respective ones of said shoulders.

8. The mixer of claim 7 wherein said housing comprises two bilaterally symmetrical housing halves sealed together with each half having corresponding half channels, said mixing units being positioned within respective half channels at one of said housing halves prior to being sealed together.

* * * * *